US005837070A

United States Patent [19]

Sainfort et al.

[11] Patent Number: 5,837,070

[45] Date of Patent: Nov. 17, 1998

[54] ALUMINUM-SILICON ALLOY SHEET FOR USE IN MECHANICAL, AIRCRAFT AND SPACECRAFT CONSTRUCTION

[75] Inventors: Pierre Sainfort, Grenoble; Denis Bechet, Saint-Egreve, both of France

[73] Assignee: Pechiney Rhenalu, Courbevoie, France

[21] Appl. No.: 537,864

[22] PCT Filed: May 29, 1995

[86] PCT No.: PCT/FR95/00693

§ 371 Date: Jan. 22, 1996

§ 102(e) Date: Jan. 22, 1996

[87] PCT Pub. No.: WO95/34691

PCT Pub. Date: Dec. 21, 1995

[30] Foreign Application Priority Data

Jun. 13, 1994 [FR] France ..... 94 07405

[51] Int. Cl.[6] ..... C22C 21/04

[52] U.S. Cl. ..... 148/552; 148/697; 148/698; 420/549; 420/548; 420/546; 420/544

[58] Field of Search ..... 420/549, 548, 420/546, 544; 148/697, 698, 552

[56] References Cited

U.S. PATENT DOCUMENTS 3,466,170 9/1969 Dunkel et al. ..... 420/546
5,571,347 11/1996 Bergsma ..... 420/549

FOREIGN PATENT DOCUMENTS 241389 10/1974 Germany ..... 420/546

*Primary Examiner*—Patrick Ryan
*Assistant Examiner*—M. Alexandra Elve
*Attorney, Agent, or Firm*—Dennis, Meserole, Pollack & Scheiner

[57] ABSTRACT

The invention relates to an aluminum alloy sheet heat treated by natural aging, quenching and possibly tempering so as to obtain a yield strength greater than 320 MPa, for use in mechanical, naval, aircraft, or spacecraft construction, with a composition (by weight) of:
Si: 6.5 to 11%
Mg: 0.5 to 1.0%
Cu: <0.8%
Fe: <0.3%

11 Claims, No Drawings

ALUMINUM-SILICON ALLOY SHEET FOR USE IN MECHANICAL, AIRCRAFT AND SPACECRAFT CONSTRUCTION

FIELD OF THE INVENTION

The invention relates to the field of medium- and high-strength aluminum alloy sheets used in mechanical, aircraft and spacecraft construction, and in armaments.

PRIOR ART

High-strength aluminum alloys have been used in aircraft and spacecraft construction for many years, particularly Al—Cu alloys from the 2000 series (according to the designation of the Aluminum Association in the USA), for example the alloys 2014, 2019 and 2024, and the Al—Zn—Mg and Al—Zn—Mg—Cu alloys from the 7000 series, for example the alloys 7020 and 7075.

The selection of an alloy and a transformation range, particularly a heat treatment range, is the product of an often delicate compromise between various working properties such as the static mechanical properties (tensile strength, yield strength, modulus of elasticity, elongation); fatigue strength, which is important for aircraft subjected to repeated takeoff-and-landing cycles; toughness, that is, resistance to crack propagation; and stress corrosion. It is also necessary to take into account the alloy's ability to be cast, rolled, and heat-treated under proper conditions, its density, and possibly its weldability.

For over thirty years, continued progress has been made in improving the properties of the 2000 and 7000 alloys used in thin metal sheets for aircraft fuselages and in medium and thick metal sheets for wings or for cryogenic vessels for rockets or missiles, for the specific purpose of lightening the structures in weight without compromising the other properties.

Major progress in lightening weight was made with the development of aluminum-lithium alloys. Thus, an 8090 alloy with 2.6% lithium results in a specific modulus (the ratio of the modulus of elasticity to the density) which is about 20% higher than that of 2024 and 24% higher than that of 7075. Alloys with a higher copper content and lower lithium content, such as 2095, were also developed because of their effective compromise between density, modulus of elasticity, and weldability. In this case the gain in the specific modulus is about 12% relative to 2219. However, these alloys are still not very widely used, essentially because of their high production cost.

OBJECT OF THE INVENTION

In the process of researching alloys for lightening the weight of aircraft structures, Applicant has discovered that another category of alloys, Al—Si alloys of the 4000 series, which are usually used in cast form, would not only make it possible to substantially improve the specific modulus by 3 to 10% relative to the 2000 and 7000 alloys, but would also have a collection of properties related to toughness, fatigue strength and stress corrosion which meet the strict requirements of aircraft construction, without posing any difficult problems during casting, rolling or heat-treatment. Moreover, these alloys have a degree of weldability which is far greater than that in most of the 2000 and 7000 alloys, and which is at least equivalent to that in the alloys in these series which were specially developed for welding, such as the alloys 2219 and 7020. Finally, they have a temperature resistance which is far greater than that of most of the 2000 and 7000 alloys, and which is at least equivalent to that of the alloys in these series which were specially developed for their temperature resistance, such as the alloys 2019 and 2618.

Al—Si alloys are quite widely used in the production of molded castings. However, in this form, their mechanical strength, fatigue strength and toughness properties are substantially lower than those of the transformed 2000 and 7000 wrought alloys used in structural parts. In rare cases, they can be used in rolled form, particularly for coating plated metal sheet intended for the production of brazed heat exchangers. Hence, the alloys 4343, 4104, 4045 and 4047 are used, since the desired properties in this case are essentially a low melting temperature and good wettability.

Al—Si alloys can also be drawn in the form of bars or sections which, because of their good temperature and wear resistance, are used in mechanical parts such as connecting rods, brake master cylinders, drive shafts, bearings and various components of motors and compressors. One of the alloys used for this purpose is 4032.

French patent FR 2291284 describes the production of sheet metals made from an Al—Si alloy containing from 4 to 15% Si by continuous casting between two cooled rolls. This method of casting is intended to increase elongation at rupture, and hence formability. It is not intended for high-strength sheet metals which are usable in structural applications, since the sheet metals are merely annealed, and the yield strengths they exhibit do not exceed 220 MPa.

But until now no one has proposed the development, by means of a judicious choice of composition and an appropriate heat treatment range, of Al—Si alloy sheet metals with high mechanical strength which are usable in structural applications, particularly in mechanical, naval, or aircraft construction, in mechanical or welded assemblies.

Another object of the invention is sheet metals which are heat treated by solution heat treating, quenching, and possibly tempering so as to obtain a yield strength $R_{0.2}$ higher than 320 MPa, for use in mechanical, naval, aircraft or spacecraft construction, made from an alloy with the following composition (by weight):

Si: 6.5 to 11%
Mg: 0.5 to 1.0%
Cu: <0.8%
Fe: <0.3%
Mn: <0.5% and/or Cr<0.5%
Sr: 0.008% to 0.025%
Ti: <0.02% in which the total of the other elements is less than 0.2% and the remainder is aluminum.

The silicon content is preferably between 6.5 and 8%, and it corresponds to that of the alloy AS7G.

Another object of the invention is the utilization of medium or thick metal sheets made from this alloy for the lower surfaces of aircraft wings, of thin metal sheets for plating aircraft fuselages, metal sheets for producing cryogenic vessels for rockets, bodies and floors of industrial vehicles, and hulls or superstructures of boats.

DESCRIPTION OF THE INVENTION

The metal sheets according to the invention have silicon contents which globally correspond to the ranges of the alloys AS7G and AS9G in accordance with the French standard NF 57-702 or the designations A 357 and A 359 of the Aluminum Association.

The magnesium content must not exceed 1%, in order to avoid the formation of an insoluble intermetallic $Mg_2Si$ compound. The copper content must be limited to 0.8% in order to avoid the formation of insoluble $Mg_2Si$ and Q (AlMgSiCu) phases. This content also limits susceptibility to intercrystalline corrosion.

The iron content is also limited, to 0.3% and preferably to 0.08%, as it is in the 7000 alloys for heavy plates, when there is a need for substantial toughness and/or good elongation. The presence of titanium is linked to the titanium refining of the plates, which is identical to that practiced with current high-strength alloys.

As is usually the case with quality casting alloys, it is necessary to modify the alloy in order to avoid the formation of primary silicon and to obtain a finely dispersed fibrous eutectic structure. For this operation, strontium is preferable to sodium, which could produce hot brittleness during the transformation.

The metal sheets according to the invention can be obtained by vertical plate casting, a hot rolling to 6 mm, possibly a cold rolling in the case of thin sheet metals, a solution heat treating between 545° and 555° C., a cold-water quenching, a precipitation hardening at the ambient temperature and/or a tempering for between 6 and 24 hours at a temperature between 150° and 195° C.

The hot rolling may be preceded by a homogenizing between 530° and 550° C. for a duration shorter than 20 hours, which is short enough to avoid the globulization of the fibrous eutectic and any marked coalescence of the manganese and/or chromium dispersoids when the alloy contains them. In the absence of homogenizing, an extremely fine, non-globulized eutectic structure is obtained in the final state, which has a favorable effect on the toughness.

Thus, in the temper T6, it is possible to obtain a yield strength greater than 320 and even 340 MPa, elongation greater than 6% in the direction TL and 9% in the direction L, and toughness, as measured by the critical stress intensity factor K1c, greater than 20 MPaVm.

Under these conditions, the alloy is weldable by conventional continuous or intermittent TIG or MIG processes used for thin or thick metal sheet, and its density is always lower than that of the traditional 2000 and 7000 alloys, as well as that of Al—Li alloys with a lithium content of less than 1%.

EXAMPLES

Example 1:

homogenized sheet metal

Plates with a 380×120 mm profile were produced by vertical casting, using an alloy with the following composition (by weight):

Si: 6.77%
Mg: 0.59%
Cu: 0.24%
Fe: 0.06%
Mn: 0.31%
Sr: 0.016%
Ti: 0.01% in which the total of the other elements was less than 0.2% and the remainder was aluminum.

The alloy was homogenized at 550° for 8 hours, after a 4-hour temperature rise, reheated for 2 hours at 500° C., then hot rolled to a thickness of 20 mm on a reversing mill. Cut metal sheets were solution heat treated for 2 hours at 550° C., quenched in water and subjected to an 8-hour tempering at 175° C., which corresponds to a T651 temper according to the designations of the Aluminum Association.

The alloy has a density of 2.678, and a modulus of elasticity E of 74,100 MPa was measured on the metal sheet using the method of the hysteresis loop in traction, which corresponds to a specific modulus of 27,670 MPa, as compared to the respective values of 2.770, 72,500 MPa and 26,175 MPa for a metal sheet of the same thickness made from the alloy 2024 in the T351 temper, indicating an increase of 5.7% in the specific modulus. This increase is more than 9% greater in relation to the alloy 2219 for welded construction.

The mechanical properties, compared to those of a 2024 T351 metal sheet, are as follows:

| Alloy | Direction | $R_{0.2}$ MPa | $R_m$ MPa | A % | Direction | $K_{1c}$ MPa√m |
|---|---|---|---|---|---|---|
| Invention | L | 358 | 386 | 9.4 | L-T | 20 |
| Invention | TL | 350 | 386 | 6.6 | T-L | 19 |
| 2024 | L | 350 | 485 | 18.0 | L-T | 35 |
| 2024 | TL | 345 | 489 | 17.1 | T-L | 32 |

Example 2:

non-homogenized sheet metal

With the same alloy as in Example 1, the same operations are carried out, except that the plate is not subjected to homogenizing prior to the reheating which precedes the hot rolling. A modulus of elasticity of 74,170 MPa is measured on the 20 mm thick metal sheet, indicating a 5.7% increase in the specific modulus relative to the 2024 T351.

The mechanical properties measured on the 20 mm sheet metal are the following:

| Direction | $R_{0.2}$ MPa | $R_m$ MPa | A % | Direction | $K_{1c}$ MPa√m |
|---|---|---|---|---|---|
| L | 359 | 384 | 10.0 | L-T | 22.1 |
| TL | 346 | 383 | 6.9 | T-L | 19.1 |

It is noted that the absence of homogenizing has a favorable effect on elongation and toughness. A comparative micrographic test shows that the average size of the silicon particles, which was on the order of 7 microns for the homogenized sheet metal, becomes less than 4 microns for the non-homogenized sheet metal.

What is claimed is:

1. A high-strength aluminum alloy sheet which is produced by casting, hot rolling and optionally cold rolling followed by heat treating by solution heat treating, quenching and possibly tempering so as to obtain a yield strength $R_{0.2}$ greater than 320 MPa, for use in mechanical, naval, aircraft, and spacecraft construction, said sheet having a composition consisting essentially of, by weight:

Si: 6.5 to 11%
Mg: 0.5 to 1.0%
Cu: <0.8%
Fe: <0.3%
Mn: <0.5% and/or Cr: <0.5%
Sr: 0.008 to 0.025%
Ti: <0.02%
total other elements: <0.2% the remainder being aluminum.

2. Metal sheet according to claim 1, wherein Si is between 6.5 and 8%.

3. Metal sheet according to claim 1, wherein iron is lower than 0.08%.

4. A process for producing metal sheets according to claim 1, which includes the following steps:

casting of a plate, reheating between 480° and 520° C., hot rolling and possibly cold rolling, solution heat treating between 545° and 555° C., cold-water quenching and precipitation hardening.

5. The process according to claim 4, including, prior to the reheating, a homogenization between 530° and 550° C. for a duration of less than 20 hours.

6. The process according to claim 4, followed by a tempering for 6 to 24 hours between 150° and 195° C.

7. A lower surface of an aircraft wing comprising a medium or thick metal sheet according to claim 1.

8. A plating for an aircraft fuselage comprising a metal sheet according to claim 1.

9. A cryogenic reservoir for a rocket comprising a metal sheet according to claim 1.

10. A floor or body for an industrial vehicle comprising a metal sheet according to claim 1.

11. A hull or superstructure for a boat comprising a metal sheet according to claim 1.

* * * * *